United States Patent [19]

Yamamoto et al.

[11] Patent Number: 5,049,100

[45] Date of Patent: Sep. 17, 1991

[54] OUTBOARD ENGINE UNIT

[75] Inventors: Hiroshi Yamamoto; Hitoshi Suzuki; Yasushi Itai, all of Saitama, Japan

[73] Assignee: Honda Giken Kogyo Kabushiki Kaisha, Tokyo, Japan

[21] Appl. No.: 509,748

[22] Filed: Apr. 17, 1990

[30] Foreign Application Priority Data

Apr. 17, 1989 [JP] Japan ..... 1-96766
Apr. 17, 1989 [JP] Japan ..... 1-96768

[51] Int. Cl.[5] ..... B63H 21/26

[52] U.S. Cl. ..... 440/77; 440/88; 440/89

[58] Field of Search ..... 440/88, 89, 90, 77, 440/84; 123/51 R, 51 B, 51 BB, 51 BC, 52 R, 65 R, 65 PE

[56] References Cited

U.S. PATENT DOCUMENTS 2,351,050 6/1944 Karey ..... 440/88
4,493,661 1/1985 Iwai ..... 440/88

FOREIGN PATENT DOCUMENTS 60-38293 2/1985 Japan .
60-95293 6/1985 Japan .

*Primary Examiner*—Sherman Basinger
*Assistant Examiner*—Stephen P. Avila
*Attorney, Agent, or Firm*—Dickstein, Shapiro & Morin

[57] ABSTRACT

An outboard engine unit for use on small ships or boats having a small-size casing assembly. The outboard engine unit includes a casing assembly, a propeller shaft disposed horizontally in a lower portion of the casing, a propeller mounted on one end of the propeller shaft and disposed outside of the casing assembly, an engine disposed in an upper portion of the casing assembly, the engine having a vertical crankshaft and at least one horizontal cylinder, and a vertical shaft disposed vertically in the casing, for transmitting rotative power of the crankshaft to the propeller shaft. The cylinder has an axis which extends parallel to and is laterally offset from the longitudinal central axis of the casing assembly as it is viewed in plan.

19 Claims, 6 Drawing Sheets

OUTBOARD ENGINE UNIT

BACKGROUND OF THE INVENTION

1. Field of the Invention:

The present invention relates to an outboard marine propulsion unit or an outboard engine unit, and more particularly to an outboard engine unit having an engine with a vertically extending crankshaft.

2. Description of the Relevant Art:

Outboard engine units detachably mounted on the stern of small ships such as boats should preferably be compact so that they can be attached and detached with ease. Particularly, the transverse dimension of outboard engine units should be as small as possible since some applications require a plurality of outboard engines to be mounted side by side on the stern of a boat for increased propulsion forces.

An outboard engine unit has a casing assembly which includes an upper engine cover which houses an engine therein. Therefore, the upper engine cover has the greatest transverse dimension among other parts of the outboard engine unit. It is known that there are many types of accessories disposed around the engine, the accessories having different shapes and sizes. Particularly, intake/fuel supply devices which are disposed on one side of the engine are relatively large in size as compared with the other engine accessories. Therefore, if the engine is positioned centrally in the engine cover, the casing assembly must be large enough to provide a space for the installation of the engine therein. However, since the large casing assembly also creates a dead space on the other side of the engine, the overall outboard engine unit is necessarily large in size. The above problem manifests itself if large-capacity intake/fuel supply devices are associated with the engine for higher engine output power.

Japanese Laid-Open Patent Publication No. 60-38293 and Japanese Laid-Open Utility Model Publication No. 60-95293, for example, each disclose an outboard engine unit including an engine whose crankshaft extends vertically. The engine has cylinders whose axes are inclined, when the outboard engine unit is viewed in plan, with respect to the longitudinal central axis of the outboard end unit which is aligned with the direction in which propulsion forces are generated by the outboard engine unit. With this arrangement, a space defined on one side of the engine within the casing assembly is larger, and a space defined on the other side of the engine within the casing assembly is smaller. Intake/fuel supply devices are disposed in the larger space. Consequently, the space available for the installation of accessories in the casing assembly is effectively utilized, and the outboard engine unit is rendered compact.

As described above, in cases where the cylinder axes are inclined with respect to the longitudinal central axis of the casing assembly, the spaces on the opposite sides of the distal ends of the cylinders, which are remote from the crankshaft, can appropriately be adjusted for efficient space utilization. However, the space around the proximal ends of the cylinders, near the crankshaft, cannot effectively be utilized because the proximal end of the cylinders are positioned transversely centrally in the casing assembly.

The inclined cylinder axes are problematic especially if the engine is large in size. More specifically, if the cylinder axes are inclined with respect to the direction in which the propulsion forces are produced, then vibrations caused by the engine due to reciprocating movement of the pistons are appreciable with large engine sizes. Therefore, some considerations or measures are required to cancel out such vibrations which would be transmitted from the engine to the hull of the boat.

SUMMARY OF THE INVENTION

According to the present invention, an outboard engine unit which has a vertical crankshaft is housed in a casing assembly that defines a surrounding external surface of the outboard engine unit. The outboard engine unit includes an engine having a cylinder whose axis extends parallel to and is laterally offset from the longitudinal central axis of the casing assembly, along which propulsive forces are produced by the outboard engine unit. The crankshaft has an axis which is offset from the axis of a vertical shaft operatively coupled to the crankshaft. Relatively large accessories such as intake/fuel supply devices or an exhaust device are disposed within the casing assembly on one side of the engine, away from which side the cylinder axis is offset.

With the cylinder axis being laterally offset from the longitudinal central axis of the casing assembly, a relatively large space is created on one side of the engine within the casing assembly. The large accessories such as intake/fuel supply devices or an exhaust device are disposed in such a relatively large space. As a result, the entire outboard engine unit is rendered compact in size. Even if the cylinder axis is laterally offset from the longitudinal central axis of the casing assembly, since the axes of the crankshaft and the vertical shaft are offset from each other, the vertical shaft may be positioned transversely centrally in the outboard engine unit, and the cylinder axis may be aligned with the direction in which propulsive forces are produced by the outboard engine unit.

The above and further objects, details and advantages of the present invention will become apparent from the following detailed description of preferred embodiments thereof, when read in conjunction with the accompanying drawings.

DETAILED DESCRIPTION OF THE PREFERRED EMBODIMENTS

Figure 1:
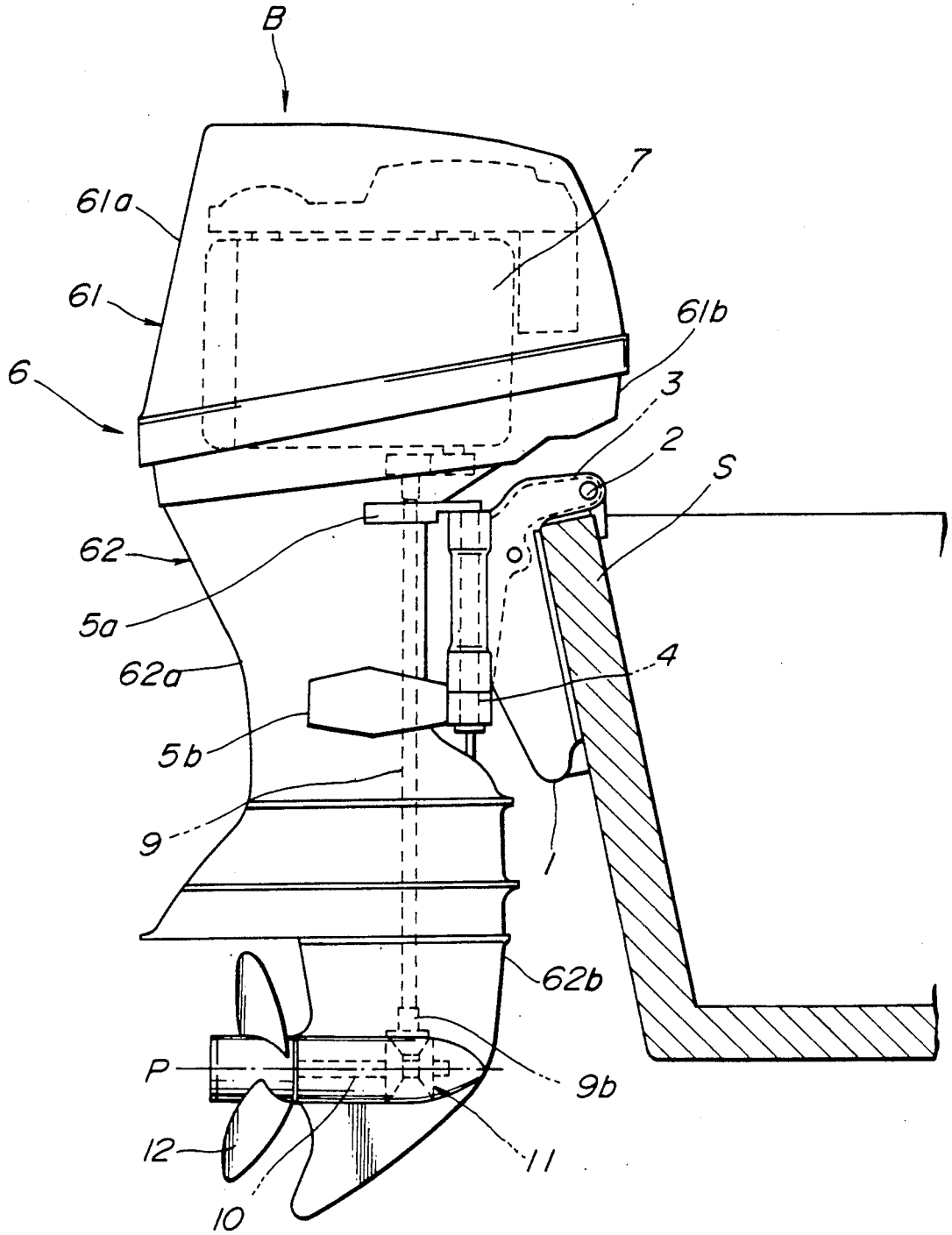
FIG. 1 is a side elevational view of an outboard engine unit according to a first embodiment of the present invention.

FIG. 1 shows an outboard engine unit or an outboard marine propulsion unit B according to a first embodiment of the present invention. The outboard engine unit B has a pair of laterally spaced stern brackets 1 which is detachably attached to the stern S of a boat by a suitable fastening means. The brackets 1 have a horizontal pivot shaft 2 on which a swivel bracket 3 is mounted for swinging movement about the pivot shaft 2 with respect to the stern S. A vertical swivel shaft 4 which is rotatable about its own axis extends through a pipe fixed to the swivel bracket 3 and is supported in the pipe. Support arms 5*a*, 5*b* are secured to and extend rearwardly from the upper and lower ends of the swivel shaft 4.

The outboard engine unit B has an outer casing assembly 6 coupled at its front portion to the support arms 5*a*, 5*b*. The casing assembly 6 defines a surrounding external surface of the entire outboard engine unit B. The casing assembly 6 comprises an engine cover 61 surrounding an engine 7, and a lower case 62 housing a power transmission mechanism including a vertical shaft 9 and a propeller shaft 10. The engine cover 61 comprises an upper cover member 61*a* and a lower cover member 61*b*, whereas the lower case 62 comprises an extension case member 62*a* and a gear case member 62*b*.

Figure 2:
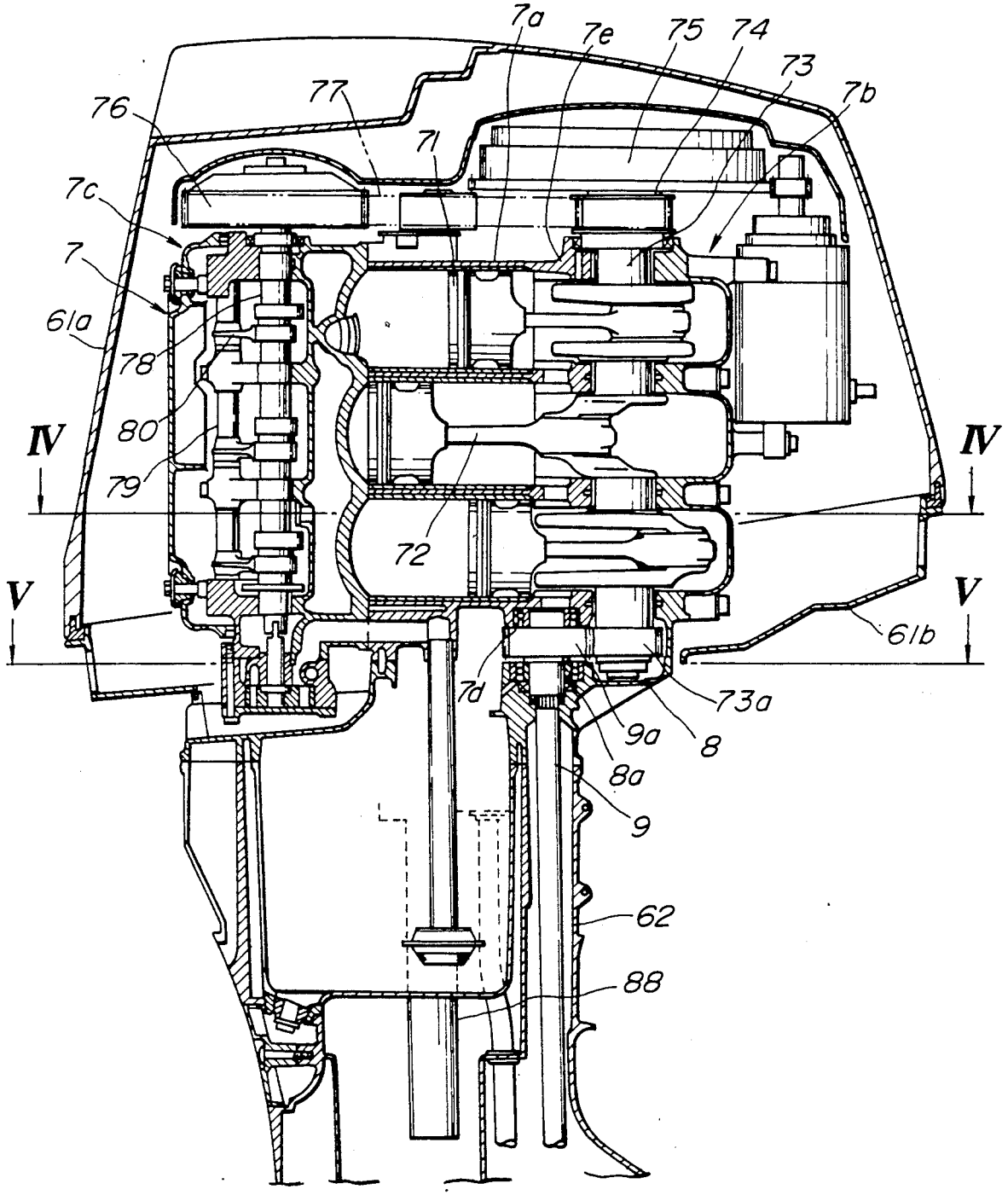
FIG. 2 is an enlarged vertical cross-sectional view of an upper portion of the outboard engine unit shown in FIG. 1.

As shown in FIG. 2, the engine 7 is supported on an engine mount 8 and housed in an upper portion of the casing assembly 6. The vertical shaft 9 has an upper end splined to a bevel gear 9*a* which is rotatably supported by a bearing 8*a* mounted on the engine mount 8 and a bearing 7*d* attached to a lower end of the engine 7. The vertical shaft 9 extends vertically downwardly from the lower end of the engine 7. As shown in FIG. 1, a bevel gear 9*b* is attached to the lower end of the vertical shaft 9, and held in mesh with bevel gears 11 mounted on the propeller shaft 10. The propeller shaft 10 has a rear end projecting rearwardly from the gear case member 62*b*, with a propeller 12 being mounted on the projecting rear end of the propeller shaft 10.

The engine 7 comprises a four-cycle in-line, three-cylinder engine of the single-overhead-camshaft (SOHC) type. More specifically, the engine 7 includes a cylinder block 7*e* which has as an vertically array or bank of three cylinders 7*a* whose axes lie horizontally. The engine 7 also has a front crankcase 7*b* and a rear cylinder head 7*c* which are integral with the cylinder block 7*e*. Pistons 71 are slidably fitted respectively in the cylinders 7*a* and coupled to a crankshaft 73 through respective connecting rods 72. The crankshaft 73 is vertically disposed in the crankcase 7*b*. of the crankshaft 73 extends vertically. The crankshaft 73 has an upper end projecting upwardly from the crankcase 7*b*. A timing pulley 74 and a flywheel 75 are mounted on the projecting upper end of the crankshaft 73.

The engine 7 also has a vertical camshaft 78 rotatably disposed in the cylinder head 7*c* and having an upper end projecting upwardly from the cylinder head 7*c*. A cam pulley 76 is mounted on the projecting upper end of the camshaft 78. The timing pulley 74 and the cam pulley 76 are operatively coupled to each other by an endless belt 77. Therefore, rotation of the crankshaft 73 is transmitted to the camshaft 78 through the timing pulley 74, the endless belt 77, and the cam pulley 76. When the camshaft 78 is rotated about its own axis, rocker arms 80 (FIG. 4) swingably supported on rocker arm shafts 79 are periodically angularly moved back and forth about the rocker arm shafts 79, thereby alternately opening and closing intake and exhaust valves 81, 82.

Figure 3:
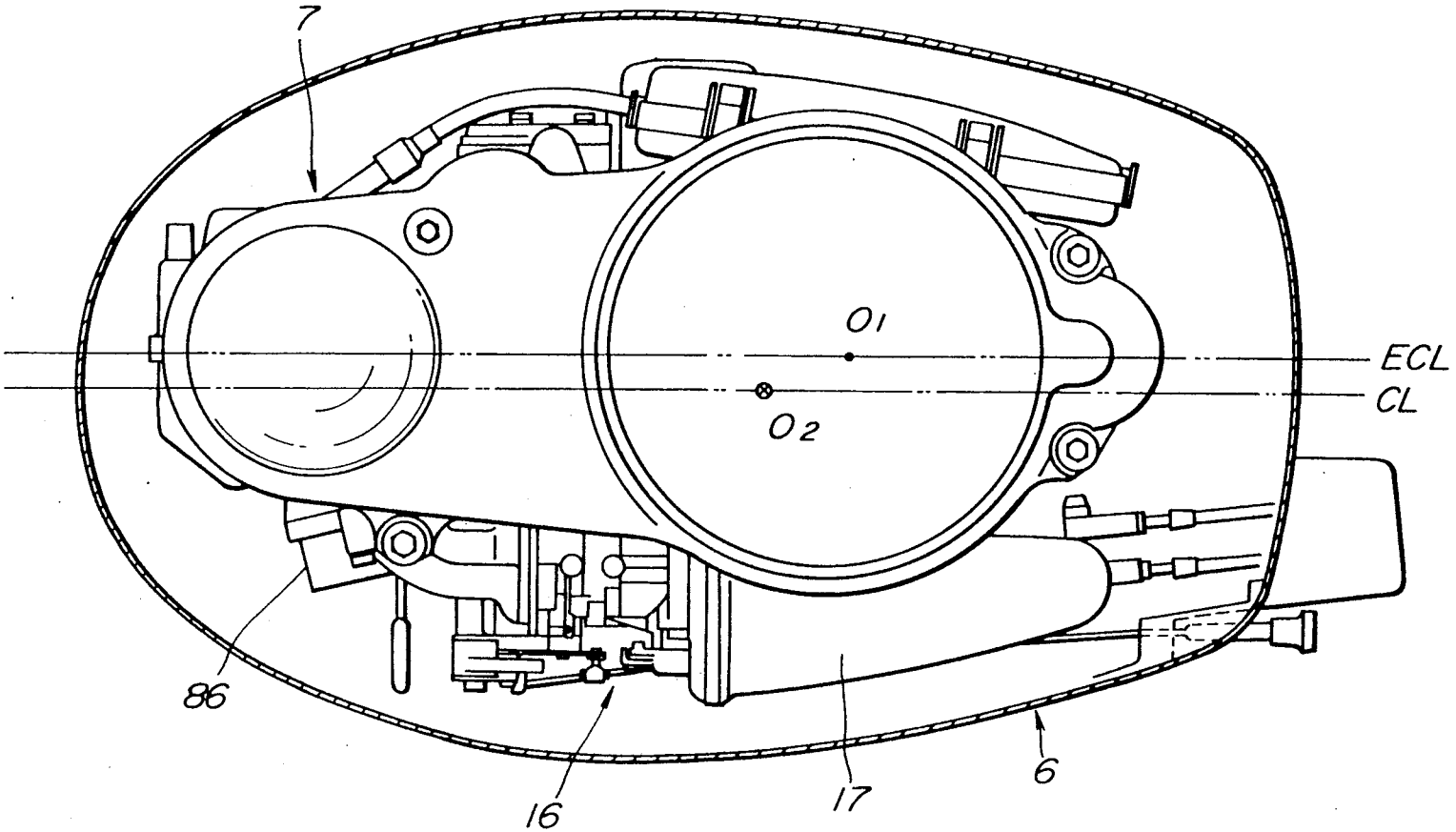
FIG. 3 is a plan view, partly cut away, of the outboard engine unit shown in FIG. 1.
Figure 4:
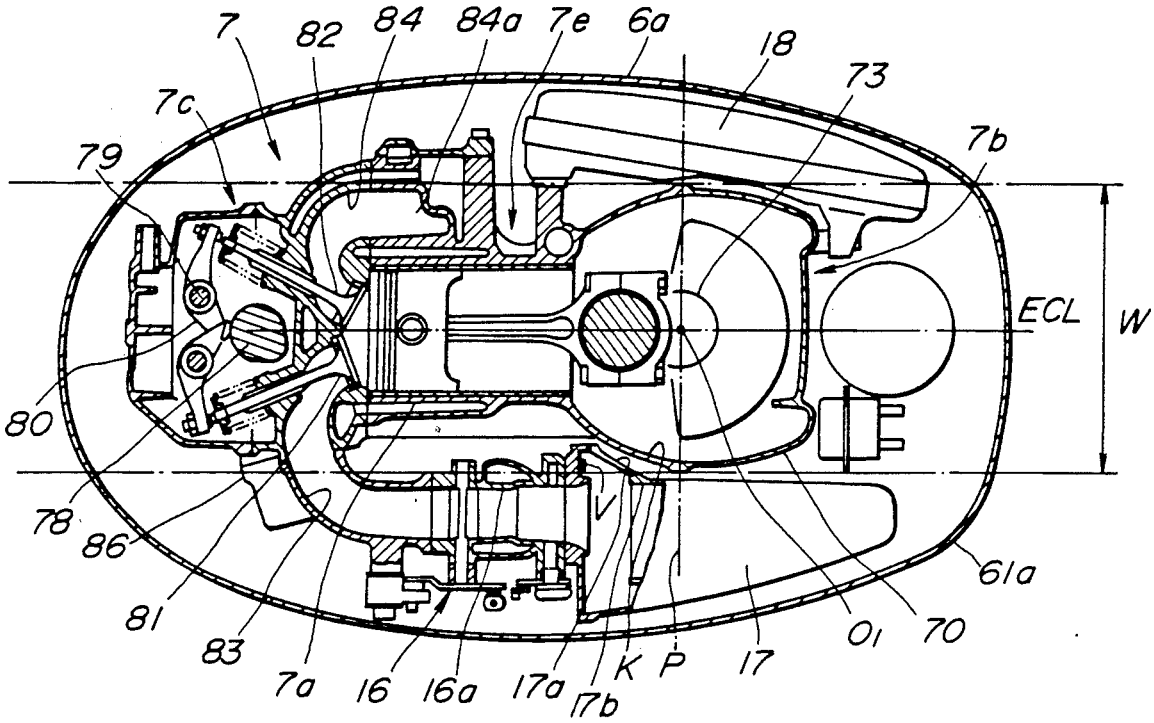
FIG. 4 is a cross-sectional view taken along line IV—IV of FIG. 2.

The intake valves 81 and the exhaust valves 82 shown in FIG. 4 are arranged in a cross-flow configuration. Intake and exhaust manifolds 83, 84 are led to opposite sides of the engine 7. The pipes or ducts of the intake manifold 83 are connected respectively to carburetors 16 (FIGS. 3 and 4) which are disposed on one side of the engine 7.

As shown in FIG. 4, the carburetors 16, an intake silencer 17 disposed on one side of the crankcase 7*b*, and a fuel pump 86 positioned beneath the intake manifold 85 jointly constitute intake/fuel supply devices.

The cylinder block 7*e* has a wider skirt K on its proximal end, the skirt K being coupled to a case 70 which is open toward the skirt K. The skirt K and the case 70 joined thereto make up the crankcase 7*b*. The skirt K and the case 70 are joined to each other along a plane P within which an axis $O_1$ of the crankshaft 73 lies.

The intake silencer 17 is connected to the carburetors 16 through a laterally projecting tapered protrusion 17*a* which is inclined along the skirt K of the cylinder block 7*e*. The intake silencer 17 is fastened to the carburetors 16 by bolts V positioned in the lateral protrusion 17*a*. The carburetors 16 have flow passages 16*a* defined respectively therein, and the intake silencer 17 also has corresponding flow passages 17*b* which are aligned with the flow passages 16*a*, respectively. These flow passages 16*a*, 17*b* extend parallel to axes ECL of the cylinders 7*a*. The intake silencer 17 is disposed as closely to the engine 7 as possible. The carburetors 16 have at least portions thereof positioned in a region which is defined between two parallel spaced planes passing through the opposite sides of the skirt K and located within the maximum width W of the crankcase 7*b*. Accordingly, the carburetors 16 are disposed closely to the side of the cylinders 7*a*.

The exhaust manifold 84 is disposed on the other side of the engine 7 remote from the intake manifold 83. The exhaust manifold 84 has a vertical array of three pipes or ducts corresponding to the engine cylinders 7*a* and connected to a common vertical duct 84*a* which is coupled to a downwardly extending exhaust pipe 88 (FIG. 2). Exhaust gases emitted from the cylinders 7*a* flow through the exhaust manifold 84 and are discharged downwardly from the engine 7 through the exhaust pipe 88. An electric parts box 18 is also disposed on the side of the crankcase 7*b* where the exhaust manifold 84 is disposed.

The axes of the cylinders 7*a* of the engine 7 are offset or spaced laterally from and extend parallel to the longitudinal central axis of the casing assembly 6 as it is viewed in plan. The offset arrangement of the cylinder axes will be described below.

Figure 5:
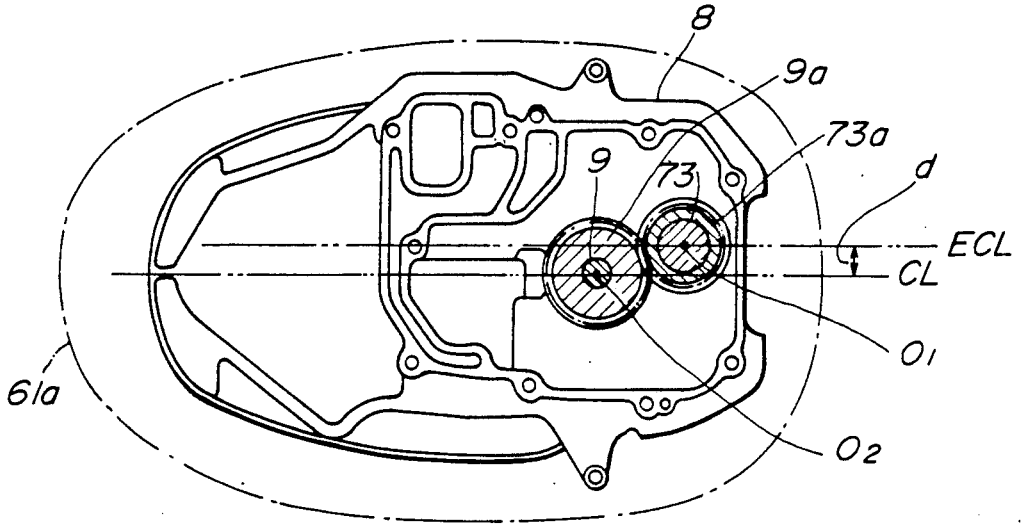
FIG. 5 is a cross-sectional view taken along line V—V of FIG. 2, the view showing an engine mount in plan.

As shown in FIG. 5, a speed reducer gear 73*a* is fixed to the lower end of the crankshaft 73, and held in mesh with the driven bevel gear 9*a* which is splined to the upper end of the vertical shaft 9. The vertical shaft 9 has an axis $O_2$ positioned on the longitudinal central axis CL of the engine cover member 61*a*. The longitudinal central axis CL of the engine cover member 61*a* is aligned with the longitudinal central axis of the lower case 62 including the extension case member 62*b*, as it is viewed in its transverse cross section. The longitudinal central axis CL is contained in a vertical central plane which is positioned on the transverse center of the entire outboard engine unit B. The propeller shaft 10 has an axis P (FIG. 1) which is also positioned on the central plane. Propulsive forces are produced by the propeller 12 in the axial direction of the propeller shaft 10.

The axis $O_1$ of the crankshaft 73 is transversely offset or spaced from the axis $O_2$ of the vertical shaft 9. The axes ECL of the cylinders 7a which pass through the crankshaft 73 are thus transversely offset or spaced a distance d from the axis $O_2$ of the vertical shaft 9. Accordingly, the axes ECL of the cylinders 7a are laterally offset or displaced from the longitudinal central line CL of the casing assembly 6 by the distance d, and extend parallel to the longitudinal central line CL. Therefore, the cylinder axes ECL lie parallel to the direction in which the propulsive forces are produced by the propeller 12.

Since the cylinder axes ECL are laterally offset from the longitudinal central axis CL of the casing assembly 6 when the outboard engine unit B is viewed in plan, the engine 7 is also laterally offset in its entirety from the central axis CL of the casing assembly 6. Therefore, a wide space is available on the side of the engine 7, away from where the cylinders 7a are laterally offset.

As shown in FIGS. 3 and 4, the intake/fuel supply devices including the large carburetors 16, the intake silencer 17, etc., among other accessories are placed in such a wide space, and arranged in a compact configuration within the casing assembly 6.

Figure 6:
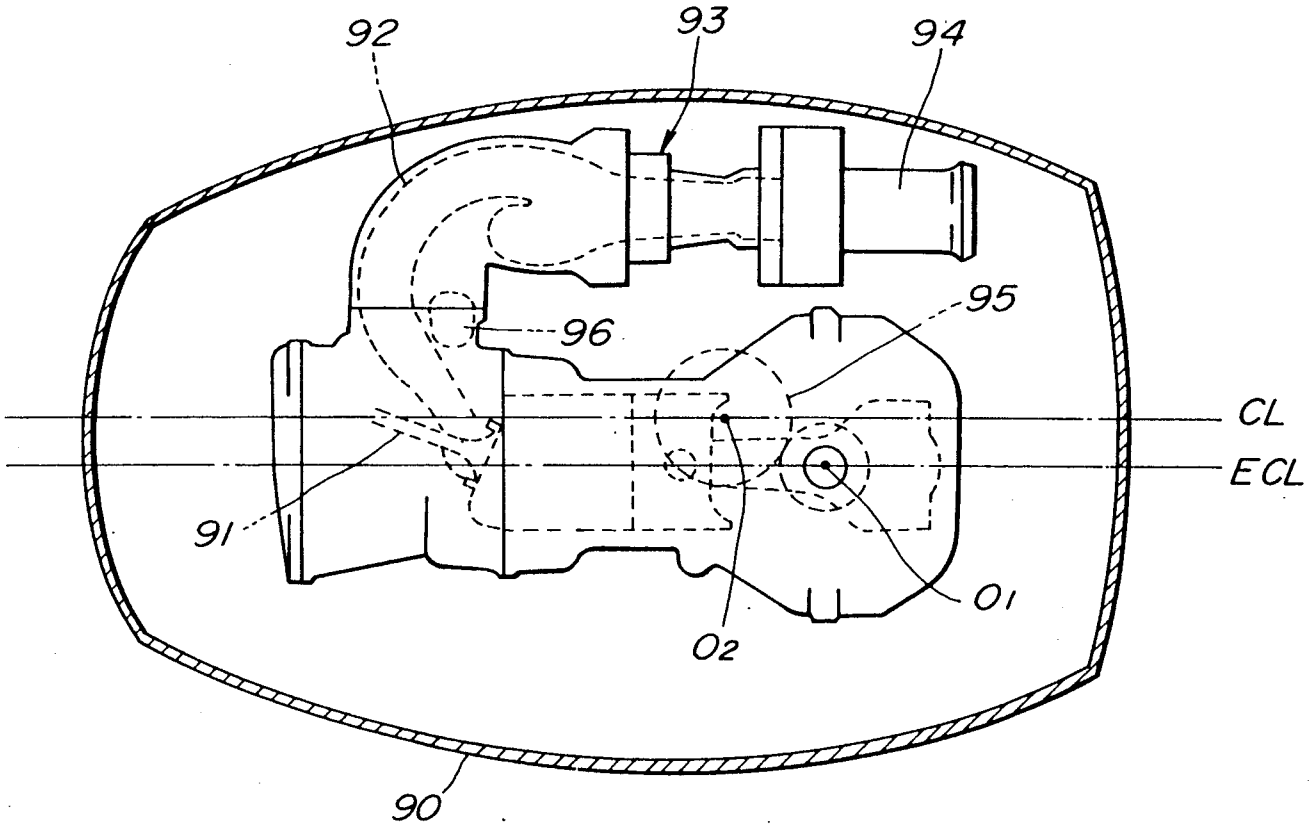
FIG. 6 is a plan view, partly cut away, of an outboard engine unit according to a second embodiment of the present invention.

FIG. 6 shows an outboard engine unit according to a second embodiment of the present invention.

As shown in FIG. 6, the outboard engine unit includes an engine having a counterflow-type valve arrangement. The engine includes intake and exhaust valves arranged in a vertical array and positioned on one side of the cylinder axis. A vertical shaft 95 has an axis $O_2$ positioned on the longitudinal central axis CL of a casing assembly 90, and the axes ECL of the cylinders are laterally offset from the central axis CL of the casing assembly 90. Carburetors 93 and air intake pipes 94 coupled thereto are disposed in a space away from which the cylinders are offset. Therefore, the casing assembly 90 is rendered small in size. Denoted in FIG. 6 at 91 is an intake valve, 92 an intake manifold, and 96 an exhaust passage.

Figure 7:
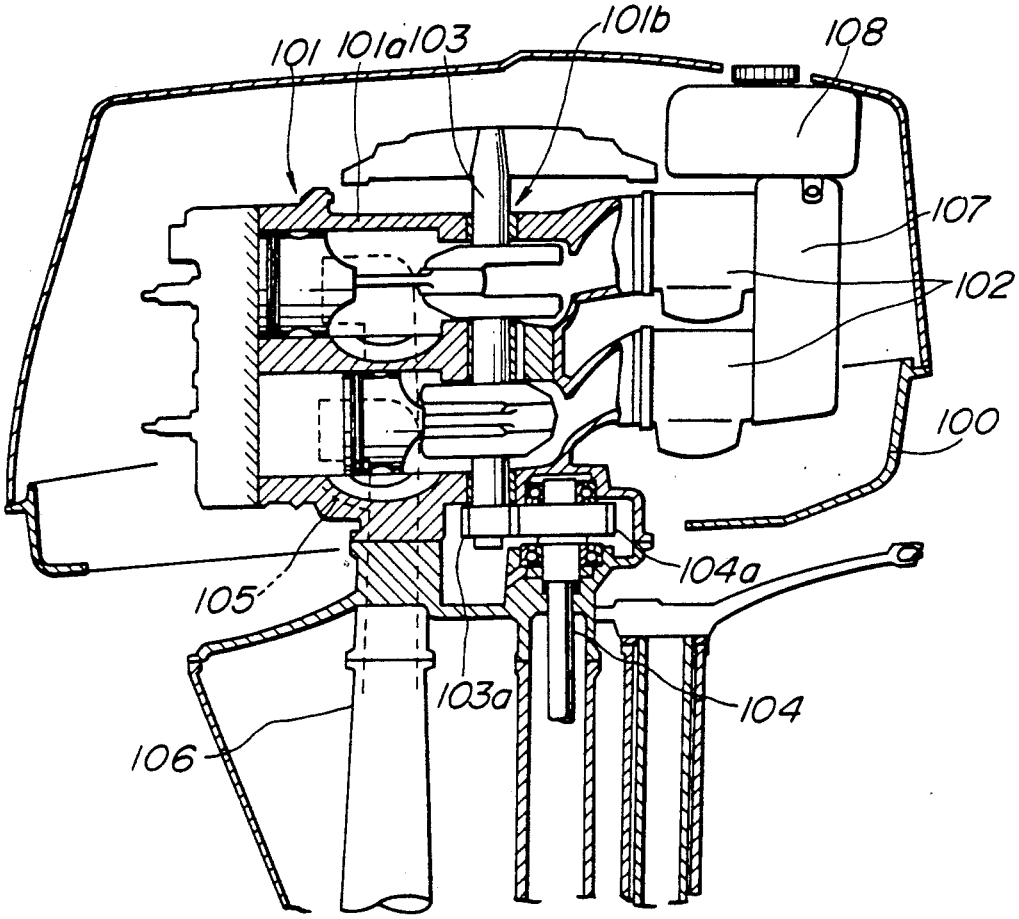
FIG. 7 is a fragmentary vertical cross-sectional view of an outboard engine unit according to a third embodiment of the present invention.
Figure 8:
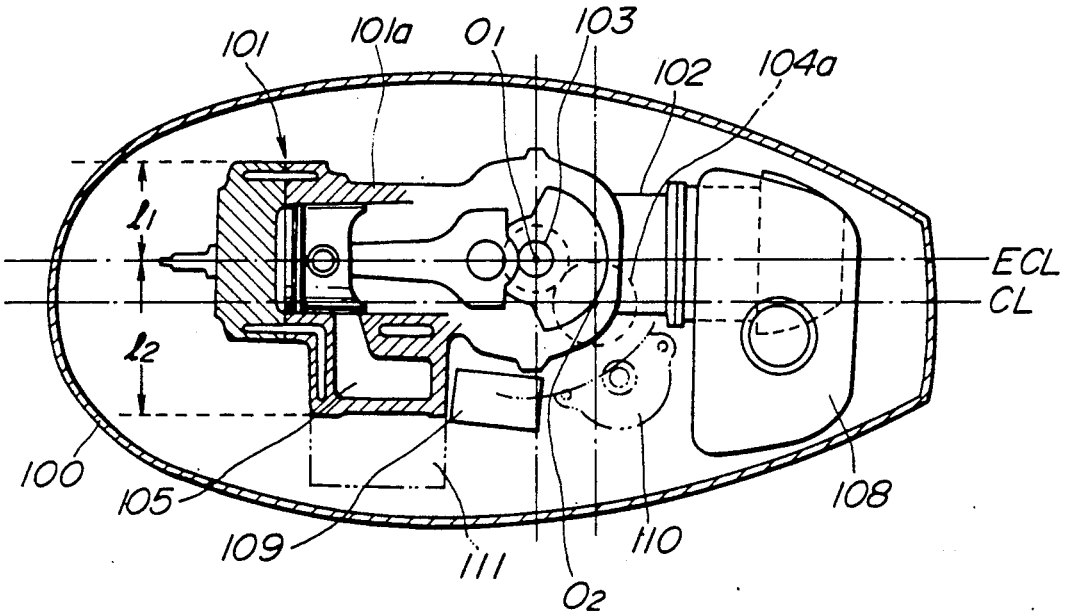
FIG. 8 is a plan view, partly cut away and in cross section, of the outboard engine unit shown in FIG. 7.

FIGS. 7 and 8 show an outboard engine unit according to a third embodiment of the present invention. The outboard engine unit shown in FIGS. 7 and 8 includes a two-cycle engine and an exhaust device which is located in a space away from where the engine cylinders are offset.

As illustrated in FIGS. 7 and 8, a two-cycle engine 101 is disposed in a casing assembly 100. Carburetors 102 are mounted on an end of a crankcase 101b and positioned on the axes ECL of the cylinders of the engine 101. A speed reducer gear 103a mounted on the lower end of a crankshaft 103 is held in mesh with a driven gear 104a mounted on the vertical shaft 104. As with the first embodiment, the crankshaft 103 has an axis $O_1$ which is laterally offset from the axis $O_2$ of the vertical shaft 104, so that the cylinder axes ECL are laterally offset from the longitudinal central axis CL of the casing assembly 100. The engine 101 has two exhaust ports 105 defined in the side of a cylinder block 101a, away from which the cylinders are offset. Exhaust gases emitted from the exhaust ports 105 are discharged out of a downwardly extending exhaust pipe 106.

As shown in FIG. 8, the transverse distance or width $l_2$ from the cylinder axes ECL to the outer ends of the exhaust ports 105 on one side of the engine is larger than the transverse distance or width $l_1$ from the cylinder axes ECL to the other side of the engine. Therefore, the engine 101 is disposed in a compact fashion within the casing assembly 100. Denoted respectively in FIGS. 7 and 8 at are an oil tank 107 an intake silencer 108, an electric parts box 109, a starter 110, and an exhaust emissions purifier 111.

Depending on the type and size of accessories to be installed, the cylinders may be laterally offset by various distances within the casing assembly. Therefore, various engines may be housed in a compact arrangement in casing assemblies. The above arrangement is particularly useful with two-cycle engines if the exhaust system is large in size because of the bulkiness of accessories that must be used such as an exhaust emissions purifier including a catalyst.

With the present invention, as described above, various engine accessories of different sizes may be appropriately disposed laterally of the engine, so that the space in the casing assembly can be efficiently utilized, and the casing assembly itself may be reduced in size. Since the axes of the engine cylinders are not aligned with the direction in which propulsive forces are generated, no harmful engine vibrations are produced. While the carburetors are disposed closely to the engine cylinders, the intake efficiency is not impaired since the flow passages in the carburetors are in line with the flow passages in the intake silencer.

Although there have been described what are at present considered to be the preferred embodiments of the present invention, it will be understood that the invention may be embodied in other specific forms without departing from its essential characteristics. The present embodiments are therefore to be considered in all aspects as illustrative, and not restrictive. The scope of the invention is indicated by the appended claims rather than by the foregoing description.

We claim:

1. An outboard engine unit comprising:

a casing assembly defining an outboard engine unit external surface;

a propeller shaft disposed horizontally in a lower portion of said casing;

a propeller mounted on one end of said propeller shaft and disposed outside of said casing assembly;

an engine disposed in an upper portion of said casing assembly and including a crankshaft having an axis extending vertically and at least one cylinder having an axis extending horizontally, said axis of said crankshaft being disposed on the extension of said axis of said cylinder; and a vertical shaft disposed vertically in said casing, for transmitting rotative power of said crankshaft to said propeller shaft;

wherein said axis of said at least one cylinder extends substantially parallel to the longitudinal central axis of said casing assembly and thereby said axes of said cylinder and said crankshaft are laterally offset from the longitudinal central axis of said casing assembly as they are viewed in plan.

2. An outboard engine unit according to claim 1, wherein said vertical shaft has an axis disposed on the longitudinal central axis of said casing assembly as it is viewed in plan, said axis of said crankshaft being laterally offset from the axis of said vertical shaft.

3. An outboard engine unit according to claim 1 or 2, wherein said casing assembly comprises an engine case covering said engine and a lower case covering said propeller shaft and said vertical shaft, said engine case having a longitudinal axis which is aligned with the longitudinal central axis of said lower case.

4. An outboard engine unit according to claim 3, wherein said propeller shaft has an axis which is aligned with the longitudinal central axis of said engine case.

5. An outboard engine unit according to claim 1 or 2, further comprising at least one intake/fuel supply device coupled to said engine, said intake/fuel supply device being disposed on one side of said engine within said casing assembly, away from which side said cylinder is laterally offset.

6. An outboard engine unit assembly according to claim 5, wherein said engine includes a cylinder block in which said cylinder is defined and a crankcase in which said crankshaft is disposed, said intake/fuel supply device including a carburetor which has at least a portion thereof positioned within a region defined between planes passing through opposite sides of said crankcase, said region being located within the maximum width of said crankcase.

7. An outboard engine unit according to claim 6, wherein said cylinder block has a wider skirt, wider than the diameter of said cylinder, on a proximal end thereof, said crankcase being composed of said skirt and a case opening toward and joined to said skirt, said crankshaft having an axis positioned in a plane along which said skirt and said case are joined to each other, said intake/fuel supply device further including an intake silencer coupled to said carburetor and disposed laterally of said crankcase, and an intake manifold coupled to said carburetor and communicating with said cylinder, said intake silencer having a tapered protrusion joined to said carburetor and extending along said skirt of the cylinder block, said carburetor having a flow passage defined therein and extending parallel to said axis of said cylinder and aligned with a flow passage defined in said intake manifold and a flow passage defined in said intake silencer.

8. An outboard engine unit according to claim 1 or 2, further comprising an exhaust device connected to said engine and disposed within said casing assembly, said exhaust device being positioned on one side of the engine away from which said axis of the cylinder is offset.

9. An outboard engine unit according to claim 8, wherein said exhaust device includes an exhaust emission purifier.

10. An outboard engine unit comprising:

a cylinder block having at least one cylinder and a wider skirt, wider than the diameter of said cylinder;

a crankcase composed of said skirt and a case opening toward and connected to said skirt;

a crankshaft disposed in said crankcase and having an axis positioned in a plane along which said skirt and said case are joined to each other;

a carburetor disposed laterally of said at least one cylinder of said cylinder block;

an intake silencer coupled to said carburetor and disposed laterally of said crankcase; and an intake manifold coupled to said carburetor and communicating with said cylinder;

said intake silencer having a tapered protrusion joined to said carburetor and extending along said skirt of the cylinder block;

said carburetor having a flow passage defined therein and extending substantially parallel to the axis of said cylinder and aligned with a flow passage defined in said intake manifold and a flow passage defined in said intake silencer.

11. An outboard engine according to claim 1, further comprising transmitting means for transmitting rotative power of said crankshaft to said vertical shaft.

12. An outboard engine unit according to claim 11, said transmitting means comprising a drive gear fixed to the lower end of said crankshaft and a driven gear held in mesh with and driven by said drive gear, said driven gear being detachably attached to the upper end of said vertical shaft.

13. An outboard engine unit according to claim 7, further comprising connecting means in said wider skirt for connecting said intake silencer to said carburetor.

14. An outboard engine unit according to claim 13, wherein said connecting means comprises bolts.

15. An outboard engine unit according to claim 3, further comprising at least one intake/fuel supply device coupled to said engine, said intake/fuel supply device being disposed on one side of said engine within said casing assembly, away from which side said cylinder is laterally offset.

16. An outboard engine unit according to claim 4, further comprising at least one intake/fuel supply device coupled to said engine, said intake/fuel supply device being disposed on one side of said engine within said casing assembly, away from which side said cylinder is laterally offset.

17. An outboard engine unit according to claim 3, further comprising an exhaust device connected to said engine and disposed within said casing assembly, said exhaust device being positioned on one side of the engine away from which said axis of the cylinder is offset.

18. An outboard engine unit according to claim 4, further comprising an exhaust device connected to said engine and disposed within said casing assembly, said exhaust device being positioned on one side of the engine away from which said axis of the cylinder is offset.

19. An outboard engine unit according to claim 5, further comprising an exhaust device connected to said engine and disposed within said casing assembly, said exhaust device being positioned on one side of the engine away from which said axis of the cylinder is offset.

* * * * *